United States Patent [19]

Sakamaki et al.

[11] Patent Number: 4,573,891

[45] Date of Patent: Mar. 4, 1986

[54] ROTARY SLEEVE OF A ROTARY COMPRESSOR

[75] Inventors: Hiroshi Sakamaki, Utsunomiya; Yukio Horikoshi, Kazo; Kikuji Yanagihashi, Yono, all of Japan

[73] Assignee: Nippon Piston Ring Kabushiki Kaisha, Tokyo, Japan

[21] Appl. No.: 611,214

[22] Filed: May 17, 1984

[30] Foreign Application Priority Data

May 20, 1983 [JP] Japan ..... 58-087619

[51] Int. Cl.[4] ..... F04C 18/344

[52] U.S. Cl. ..... 418/173

[58] Field of Search ..... 418/172, 173, 174, 270; 308/DIG. 1; 384/107, 109, 110; 433/132

[56] References Cited

U.S. PATENT DOCUMENTS 3,447,841 6/1969 Fernlund ..... 384/109

4,184,720 1/1980 Zacherl ..... 384/109

FOREIGN PATENT DOCUMENTS 2107790 5/1983 United Kingdom ..... 418/173

*Primary Examiner*—Leonard E. Smith

*Attorney, Agent, or Firm*—Birch, Stewart, Kolasch & Birch

[57] ABSTRACT

The rotary compressor according to the present invention is constructed such that a rotary sleeve is rotatably floating, and suspended within a central housing by means of a pneumatic bearing chamber. A rotor, whose vane can move freely into and out of said rotor is rotatably housed in said rotary sleeve. The outside surface of said rotary sleeve is formed like a barrel, whose radius diminishes axially from the midpoint toward both ends. The inside surface of said central housing spacedly follows the outside surface of said rotary sleeve. Under this construction the rotary sleeve can be automatically adjusted and stabilized in position within the central housing in both the axial and the oscillating directions. Also under this construction which prevents contact between the rotary sleeve and the central housing, wear, scuffing or seizure can be avoided even if the rotary sleeve in thermally deformed and bent outwardly at both ends.

6 Claims, 4 Drawing Figures

ROTARY SLEEVE OF A ROTARY COMPRESSOR

BACKGROUND OF THE INVENTION

1. Field of the Invention

The present invention relates to a rotary compressor in which a rotary sleeve is floatingly suspended in the central housing and a rotor with a vane is rotatably housed within said rotary sleeve. More specifically, the present invention is directed to the floating-suspension mechanism of the rotary sleeve.

2. Description of the Prior Art

Generally speaking, the vane-type rotary compressor is required to have a different performance depending on the intended use. For instance, an auto-engine supercharger is required to withstand high pressure and a wide range of rpms.

For this purpose it is effective to provide between the central housing and the vaned rotor, a rotary sleeve floatingly suspended relative to said central housing through a pneumatic bearing chamber, and to minimize the friction between the vane and the rotary sleeve by making the rotary sleeve rotate together with said rotor. Such an arrangement suppresses heat generation due to the rotational friction of the vane, realizing a non-lubricated rotation and large flow rate in a wide range of rpms.

In the above rotary compressor, whose rotary sleeve is floatingly suspended within the central housing, for the sake of smooth rotation, the rotary sleeve must maintain rotation without any deviation in the radial and axial directions and without contacting the central housing or the side housing. In other words the rotary sleeve must rotate at a specific position within the central housing and it should not be displaced so as to touch the inside surface of the central housing or the front or rear housing on both sides thereof and to cause wear or seizure.

The rotary sleeve is liable to be thermally deformed into a hourglass shape on account of its inside being heated by an adiabatically compressed gas, resulting in contact of both of its ends with the central housing.

Moreover, since the load acting on the rotary sleeve tends to be large at the center and progressively small toward the ends, it may happen that both ends of the rotary sleeve displace and come into contact with the central housing. Even under such contact, however, the rotary sleeve should be prevented from being excessively worn or being seized with the central housing.

SUMMARY OF THE INVENTION

The object of the present invention is to maintain an appropriate rotational position of the rotary sleeve within the central housing and, even if contact happens between them, to avoid shoulder contact, for the purpose of eliminating the possibility of wear or seizure due to their contact under rotation.

To accomplish the above object, the rotary compressor according to the present invention is constructed such that the rotary sleeve is rotatably floating and suspended within the central housing by means of a pneumatic bearing chamber. The rotor, into and out of which the vane can freely move, is rotatably housed within the rotary sleeve. The outside surface of the rotary sleeve is formed like a barrel so that its radius can diminish from the center toward both ends in the axial direction. At the same time the inside surface of the central housing spacedly follows the outside surface of the rotary sleeve.

Under this construction, the rotary sleeve is positionally stabilized with automatic adjustment of its position in the axial and oscillating directions within the central housing. And since the rotary sleeve is formed like a barrel, the rotary sleeve, even if it is deformed outward by thermal deformation, is not likely to contact the inside surface of the central housing. Depending on the size of the clearance taken between both ends of the rotary sleeve and the central housing, contact with the inside surface of the central housing can be effectively avoided. Also, contact between both ends of the rotary sleeve and the central housing when the rotary sleeve is displaced can be prevented. Wear, scuffing or seizure can be prevented through this anti-contact constitution.

BRIEF DESCRIPTION OF THE DRAWINGS

The above and other objects, features and advantages of the invention will become apparent and more readily appreciated from the following detailed description of exemplary embodiments of the present invention, taken in conjunction with the accompanying drawings, of which.

DETAILED DESCRIPTION OF THE PREFERRED EMBODIMENTS

Figure 1:
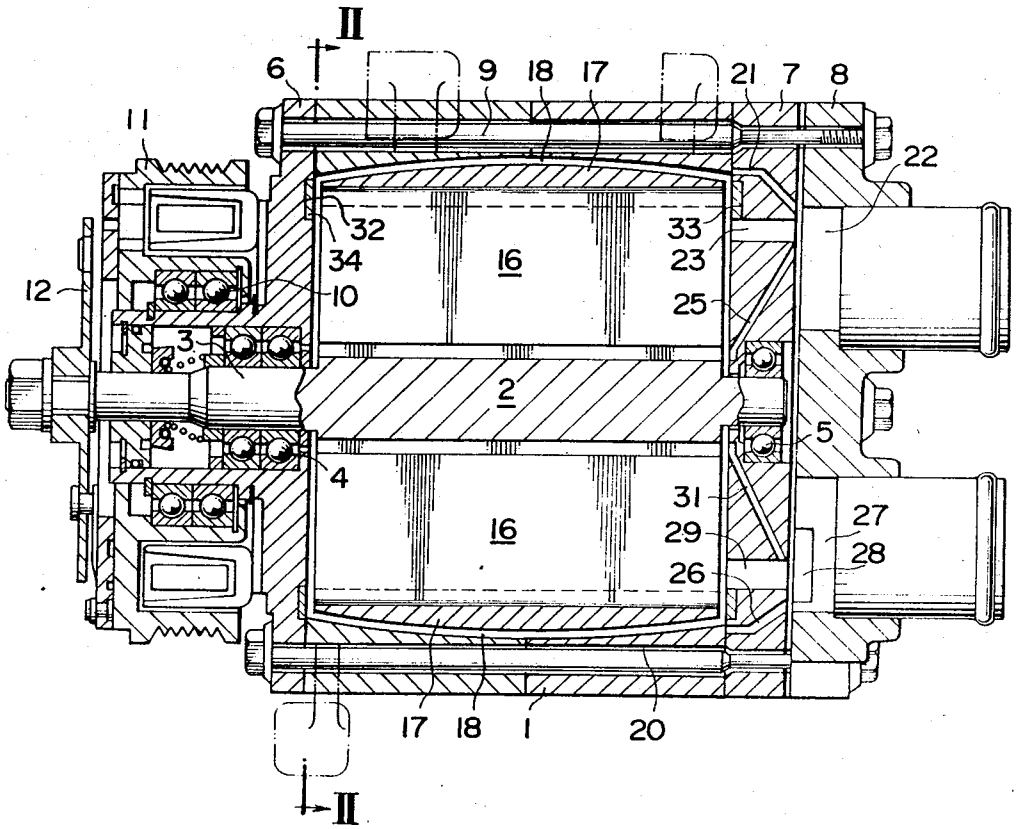
FIG. 1 is a sectional view of a rotary compressor in one embodiment of the present invention.

The present invention will now be described by referring to the drawings.

Figure 2:
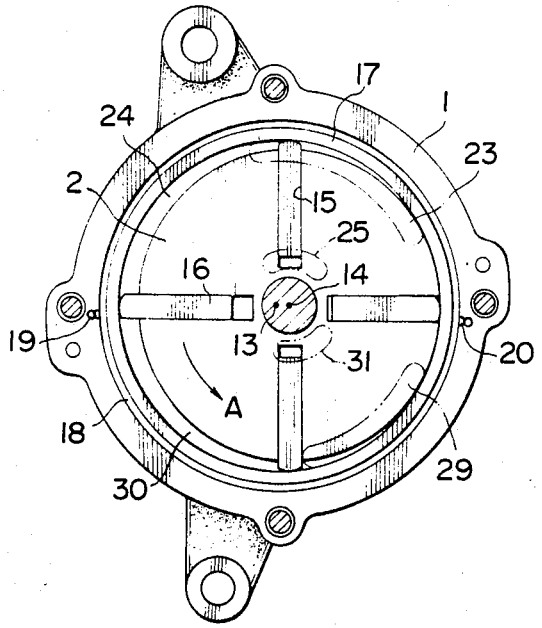
FIG. 2 is a sectional view taken along line II—II of FIG. 1.
Figure 3:
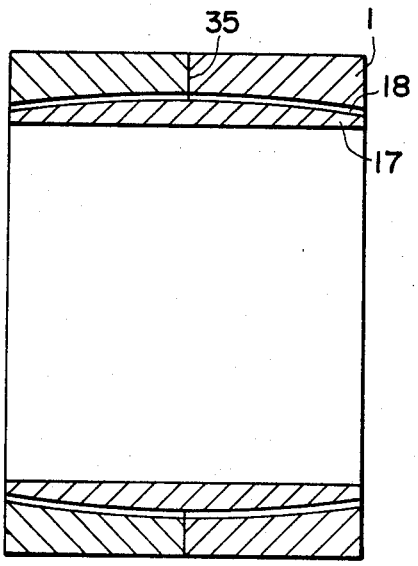
FIG. 3 is a sectional view illustrating the rotary sleeve and the central housing of the rotary compressor shown in FIG. 1.

FIGS. 1 to 3 illustrate a rotary compressor in one embodiment of the present invention. In these figures, 1 is the central housing and 2 is the rotor housed in the central housing 1. The rotor 2 is rotatably supported by the bearings 4, 5 at the rotating shaft 3 integrated to the rotor 2. The bearings 4 and 5 are respectively fitted to the front side housing 6 and to the rear side housing 7. The front side housing 6, the rear side housing 7 and the rear cover 8 provided outside of the rear side housing 7 are fastened to the central housing 1 by means of a bolt 9 extending through the central housing 1. The rotating shaft 3 of the rotor 2 is connected via the rotating member 12 to a pulley 11 rotatably supported by the front side housing 6 via a bearing 10. A rotating force is transmitted to the pulley 11 via a drive mechanism, not shown, for example, an engine crankshaft.

The rotor 2, as indicated in FIG. 2, has its axial center 14 located at a position eccentric to the axial center 13 of the central housing 1. The rotor 2 has a plurality of vane grooves 15 with a bottom which extend in the radial direction of the rotor 2 and opens toward the inside surface of the central housing 1. A vane 16 can freely move into and out of the vane groove 15 in the direction toward the inside surface of the central housing 1.

Between the vane 16 and the inside surface of the central housing 1 there is rotatably located a rotary sleeve 17 consisting of a ring member with substantially the same axial center as the axial center 13 of the central housing 1. The clearance between the outside surface of the rotary sleeve 17 and the inside surface of the central housing 1 constitutes a pneumatic bearing chamber 18. The pneumatic bearing chamber 18 extends over the entire outside of the rotary sleeve 17 and the rotary sleeve 17 is floatingly suspended by means of the pneumatic bearing chamber 18 in the central housing 1. Into the pneumatic bearing chamber 18 opens a gas inlet 19 and a gas oulet 20 which are formed like a straight slit on the inside of the central housing 1 extending parallel to the axis of the rotary sleeve 17. The inlet 19 may be a zigzag slit or an isosceles triangle with its apex pointing in the rotating direction. The inlet 19 communicates with a suction chamber 22 formed in the rear cover 8 through a gas supply hole 21 formed in the rear side housing 7.

The suction chamber 22 is formed in the rear side housing 7 and, as shown in FIG. 2, it communicates with the suction side work chamber 24, located between the rotor 2 and the rotary sleeve 17, through a suction hole 23 opening at the rotor side in the form of an arc. The suction chamber 22 communicates also with a space formed between the bottom of the vane groove 15 and the vane 16 through a communication hole 25 opening at the rotor side in the form of an arc.

Meanwhile the outlet 20 communicates with an exhaust chamber 27, formed in the rear cover 8, through a gas discharge hole 26 formed in the rear side housing 7. The exhaust chamber 27 communicates with an exhaust hole 29, formed in the rear side housing 7, through an exhaust valve 28. The exhaust hole 29 opens in an arc at the rotor side and communicates with the exhaust side work chamber 30 located between the rotor 2 and the rotary sleeve 17, as well as with a space formed between the bottom of the vane groove 15 and the vane 16 through a communication hole 31 opening in an arc at the rotor side.

As illustrated in FIG. 2, the gas inlet 19 and the gas outlet 20 are respectively located at the start and at the end of the exhaust side work area as viewed from the rotating direction A of the rotor 2.

On the inside of the front side housing 6 and the rear side housing 7 respectively, opposed to the two ends of the rotary sleeve 17 are formed annular grooves 32, 33 which open to the side of the rotary sleeve 17. To the grooves 32 and 33 is fitted an annular non-lubricated sliding member 34. The sliding member 34 is fabricated of a self-lubricating carbon base material.

Turning again to the rotary sleeve 17, as particularly shown in FIG. 3, the rotary sleeve 17 is formed to a barrel shape such that its radius is gradually reduced in the axial direction from the center toward both ends. Being truly cylindrical on the inside surface, the rotary sleeve 17 is increasingly thin toward both ends. However it is desirable that the barrel be formed such that its thickness at both ends is less than $\frac{1}{2}$ of the thickness at the center. If the taper is greater than this, the thickness at both ends will be too small, causing a problem from a standpoint of strength.

Meanwhile, the inside surface of the central housing 1 is constructed to spacedly follow the outside surface of the rotary sleeve 17.

In order to fit the barrel-like rotary sleeve 17 into the central housing 1, the central housing 1 has to be axially divided, say, into two sections. Reference numeral 35 denotes the dividing line.

Figure 4:
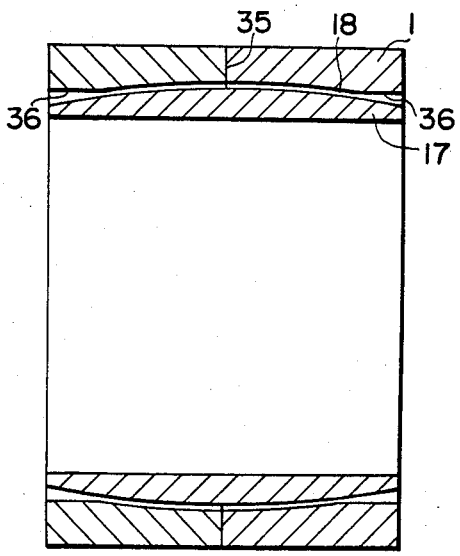
FIG. 4 is a sectional view of the rotary sleeve and the central housing in another embodiment of the present invention.

FIG. 4 illustrates the relative construction of the rotary sleeve 17 and the central housing 1 in another embodiment of the present invention.

In this embodiment too, the rotary sleeve 17 is formed like a barrel. The inside surface of the central housing 1 is also constructed to spacedly follow the profile of the outside surface of the rotary sleeve 17. But at both ends in the axial direction, the spacing to the outside surface of the rotary sleeve 17 is made wider than elsewhere. For instance, as shown in FIG. 4, only at both ends in the axial direction, the inside surface of the central housing 1 is formed like a cylinder 36 with equal radius. Otherwise the construction is the same as in the first embodiment. Therefore, the description is omitted with like symbols of FIG. 3 assigned to like parts of FIG. 4.

Next the action in the rotary sleeve thus constructed is described.

First the performance of the rotary compressor is described. The force from the engine is transmitted to the pulley 11, and from the pulley 11 to the rotor 2 via the rotating member 12 and the rotating shaft 3, whereupon the rotor 2 is driven. As the rotor 2 rotates, the vane 16 is pushed outward in the radial direction by the centrifugal force and is pressed against the inside surface of the rotary sleeve 17. With the rotation of the rotor 2 and the vane 16, the gas is drawn from the suction chamber 22 via the suction hole 23 into the suction side work chamber 24. The gas thus drawn into the chamber 24 reaches the exhaust side work chamber 30 with the rotation of the rotor 2 and is compressed in the clearance between the rotor 2 and the inside of the rotary sleeve 17. The clearance is progressively narrowed in the rotating direction A. The gas thus compressed is discharged from the exhaust chamber 27 through the exhaust hole 29. Between the vane 16 and the bottom of the vane groove 15 a gas is introduced through the communication hole 25 so that the vane 16 can smoothly reciprocate within the vane groove 15 and the gas is discharged through the communication hole 31.

When the friction of the rotary sleeve 17 against the vane 16 exceeds the friction of the rotary sleeve 17 against the inside surface of the central housing 1, the rotary sleeve 17 begins to rotate together with the vane 16. Then the gas travels via the inlet 19 into the pneumatic bearing chamber 18. When the rotary sleeve 17 becomes floatingly suspended in the central housing 1 by means of the pneumatic bearing, the friction between the rotary sleeve 17 and the central housing 1 is drastically reduced and a smooth rotation is obtained.

Since the gas inlet 19 is located at the start of the exhaust side work area and the gas outlet 20 is located at the end of the exhaust side work area, the gas is preferentially introduced to that part of the pneumatic bearing chamber 18 corresponding to the exhaust side area where the rotary sleeve 17 tends to be pressed against the inside surface of the central housing 1 by a high pressure in the exhaust side work chamber 30. Thus the clearance between the rotary sleeve 17 and the central housing 1 is ensured, yielding a good effect of the pneumatic bearing.

Next, the barrel-like function of the rotary sleeve 17 is to be described. When the rotary sleeve 17 is displaced axially in one direction, say, to the right in FIGS. 1, 3 or 4, the clearance to the pneumatic bearing chamber 18 on the right side between the rotary sleeve 17 and the central housing 1 becomes narrow. As a consequence the air pressure in the pneumatic bearing chamber 18 on the right side is increased, while the air pressure in the pneumatic bearing chamber 18 on the left side decreases. Thereupon the tapered rotary sleeve 17 is thrusted leftward and returns to its original position. When the rotary sleeve 17 is displaced to the left, a rightward thrust acts on the rotary sleeve 17 and the rotary sleeve 17 is equally restored to the original position. A similar restoring force acts also when the rotary sleeve 17 oscillates. By virtue of such a restoring action the rotary sleeve 17 can be held stably in a floating condition under its rotation and this positional control is attained automatically.

Meanwhile, the rotary sleeve 17, whose inside is heated by an adiabatically compressed gas and becomes hotter than the outside, is thermally deformed with its free ends tend to bend outward.

Being barrel-shaped, however, the rotary sleeve 17 has both of its ends virtually chamferred and accordingly it is less likely to come into contact with the inside surface of the central housing than if it were in a true cylindrical form. When, as illustrated in the second embodiment, both ends of the central housing 1 are formed to be truly cylindrical, there is a wide clearance between the outer edges of the rotary sleeve 17 and the inside surface of the central housing 1, and accordingly the rotary sleeve 17 is not likely to contact the central housing 1, because the amount of bending under thermal deformation will be slight.

Further, even if the rotary sleeve 17 oscillates within the central housing 1, on account of the above-mentioned chamferred effect the contact between the ends of the rotary sleeve 17 and the inside surface of the central housing 1 will be a plane contact instead of a knife-edge contact and therefore occurrence of scuffing or seizure can be avoided.

In the second embodiment there can be no contact of the ends; and, even if contact happens, scuffing or seizure can be practically prevented.

As explained above, in the rotary compressor according to the present invention the rotary sleeve, which has a barrel-like form, can be stabilized in a floating condition within the central housing and there is no possibility of wear, scuffing or seizure caused through thermal deformation of the rotary sleeve or through contact of its ends with the central housing due to displacement of the rotary sleeve.

Although only preferred embodiments of the present invention have been described in detail, it will be appreciated by those skilled in the art that various modifications and alterations can be made to the particular embodiments shown without materially departing from the novel teachings and advantages of this invention. Accordingly, it is to be understood that all such modifications and alterations are included within the scope of the invention as defined by the following claims.

What is claimed is:

1. A rotary compressor comprising:

a central housing with an internal cavity;

a rotary sleeve rotatably floating, suspended within said central housing by means of a pneumatic bearing chamber, the radial distance between the rotary sleeve and the central housing being wider at both end portions of the rotary sleeve;

a rotor rotatably housed in said rotary sleeve and a vane free to move into and out of said rotor;

a barrel formed on the outside surface of said rotary sleeve, the radius of said barrel gradually diminishing from the axial center toward both ends; and a barrel formed on the inside surface of said central housing, said barrel on the inside surface of said central housing spacedly following said barrel formed on the outside surface of said rotary sleeve at least over one part of the length of said rotary sleeve.

2. The rotary compressor of claim 1, wherein said barrel formed on the inside surface of said central housing spacedly follows said barrel formed on the outside surface of said rotary sleeve over the full length of said rotary sleeve.

3. The rotary compressor of claim 1, wherein said barrel formed on the inside surface of said central housing spacedly follows said barrel formed on the outside surface of said rotary sleeve over one part of the length of said rotary sleeve.

4. The rotary compressor of claim 3, wherein the inside surface of said central housing extends parallel to the axis of said rotary sleeve at both ends of said rotary sleeve.

5. The rotary compressor of claim 1, wherein said barrel of said rotary sleeve is formed such that the thickness at both of its ends is more than ½ of the thickness at its midpoint.

6. The rotary compressor of claim 1, wherein said central housing is axially divided into a plurality of sections.

* * * * *